United States Patent [19]

Crepy et al.

[11] Patent Number: 4,924,508

[45] Date of Patent: May 8, 1990

[54] PITCH DETECTION FOR USE IN A PREDICTIVE SPEECH CODER

[75] Inventors: Hubert Crepy, Paris; Philippe Elie, La Gaude; Claude Galand, Cagnes sur Mer; Emmanuel Lancon, Nice; Thierry Liethoudt, Nice; Michele Rosso, Nice, all of France

[73] Assignee: International Business Machines, Armonk, N.Y.

[21] Appl. No.: 155,459

[22] Filed: Feb. 12, 1988

[30] Foreign Application Priority Data

May 3, 1987 [FR] France ..... 87 430006

[51] Int. Cl.[5] ..... G10L 9/08; G10L 7/02

[52] U.S. Cl. ..... 381/38; 381/49

[58] Field of Search ..... 381/36–41, 381/29–32, 49; 375/25, 122; 364/513.5

[56] References Cited

U.S. PATENT DOCUMENTS

| | | | |
|---|---|---|---|
| 3,573,612 | 4/1971 | Scarr | 381/49 |
| 3,916,105 | 10/1975 | McCray | 381/49 |
| 4,015,088 | 3/1977 | Dubnowski et al. | 381/49 |
| 4,516,259 | 5/1985 | Yato et al. | 381/36 |
| 4,757,517 | 7/1988 | Yatsuzuka | 375/122 |

FOREIGN PATENT DOCUMENTS

| | | |
|---|---|---|
| 2150377A | 6/1985 | European Pat. Off. . |
| 2351467 | 12/1977 | France . |

OTHER PUBLICATIONS

Yun et al., "Piecewise Linear Quantization of LPC Reflection Coefficients", IEEE ICASSP 77, 5/77, pp. 417–420.

Galand et al., "Voice Excited Predictive Coder", IBM J. Res. Develop., vol. 29, No. 2, Mar. 1985, pp. 147–157.

Markel et al., "Linear Prediction of Speech", Springer Verlag 1976, pp. 94–95.

Kroon et al., "Regular Pulse Excitation", IEEE Trans. ASSP, vol. ASSP-34, No. 5, 10/86, pp. 1054–1059.

J. Le Roux et al., "A Fixed Point Computation of Partial Correlation Coefficients", IEEE Trans. ASSP, vol. ASSP-25, No. 3 6/77, pp. 257–259.

*Primary Examiner*—David L. Clark

*Assistant Examiner*—John A. Merecki

*Attorney, Agent, or Firm*—L. Keith Stephens

[57] ABSTRACT

A pitch detector to adjust long term prediction in a pulse excitation speech coder. A residual signal r(n) is first derived from the speech signal s(n) by short term filtering. Then, r(n) is processed to calculate a prediction error signal e(n) which is subsequently pulse excitation encoded. The processing of e(n) entails prediction of a residual by measuring a pitch related factor M, employing two steps. First calculating a coarse M value through peak clipping and sign transition detection, and then adjusting the M value by autocorrelation—calculations about the roughly spaced peaks.

12 Claims, 11 Drawing Sheets

PITCH DETECTION FOR USE IN A PREDICTIVE SPEECH CODER

FIELD OF INVENTION

This invention deals with methods for efficiently coding speech signals.

BACKGROUND OF INVENTION

Many speech coder families are already known, such as the vocoder and Linear Prediction Coder (LPC) families. The vocoder family derives the original speech signal from a set of coefficients used to process the original speech signal and derive therefrom a residual signal. A pitch information is then derived from the residual for voiced speech sections, otherwise the residual signal is simply made to be noise. The correlative decoding process involves modulating back a synthesized pitch or noise signal by the coefficients. The relative efficiency (quality versus bit rate) of such a coding scheme is rather poor unless performing a very precise determination of the pitch value. This already shows the significance of any efficient method for determining the pitch. Also with a reasonable increase in the complexity of the coder, the LPC coder family provides valuable improvement to the coding/decoding operation. Needless to mention the importance of any savings into the bit coding rate and or the coder complexity, for the voice processing industry. Saving in computing complexity enables minimization of processor workload, while saving in bit rate is of major importance in voice transmission or in storage facilities. These reasons enable understanding the full meaning of engineers efforts to optimize their coders in order to save a few coding bits, i.e. minimize the bit rate required for coding the speech signal, while keeping the coding quality quite unchanged.

The above considerations not only enable appreciating the engineering value of one coding scheme versus the others, but they might be of great significance to business value appreciation of a given coding/compressing scheme.

In summary, in the LPC type of coding schemes one may improve the coding/decoding quality considerably by efficiently detecting the pitch and by adding more information than usually done about the residual signal. Significant improvements are made by judiciously designing the coder even within a same sub-family of coders such as the ones known as:

Voice Excited Predictive Coder (VEPC) as disclosed in IBM Journal of Research and Development Vol. 29, Number 2, March 1985;

Multi-Pulse Excited Coder (MPE); or

Regular Pulse Excited Coder (RPE), as disclosed in the article "Regular Pulse Excitation, a Novel Approach to effective and Efficient Multipulse Coding a Speech", published by P. Kroon et al. in IEEE Transactions on Acoustics Speech and Signal Processing Vol ASSP 34 N05 Oct. 1986; and in a Thesis "Etude, Simulation et mise en oeuvre sur microprocesseur de codeurs predictifs multiimpulsionnels", presented by E. Landon, on Nov. 22, 1985 before the University of Nice, France.

SUMMARY OF INVENTION

It is therefore an object of this invention to provide an efficient method for determining voice pitch related information.

It is a further object of the invention to provide a coder architecture wherein said pitch related information may be used to improve the speech signal coding scheme from an efficiency standpoint.

According to the invention, these objects are accomplished by processing the original speech signal to derive therefrom a speech representative residual signal, compute residual prediction signal using long term prediction means adjusted by using pitch detection operations, then combine both current predicted residual to generate a residual error signal and code the latter using Pulse Excitation Coding techniques. A significant improvement to the coding scheme efficiency is provided by detecting the pitch or an harmonic of said pitch (hereafter simply designated by pitch or pitch representative information or pitch related information) using dual-steps process including first a coarse pitch determination through peak detection, then followed by autocorrelation operations about the detected pitched peaks.

BRIEF DESCRIPTION OF THE DRAWINGS

The foregoing and other objects, aspects and advantages of the invention will be better understood from the following detailed description of the preferred embodiment of the invention with reference to the accompanying drawings, in which.

DESCRIPTION OF THE PREFERRED EMBODIMENT OF THE INVENTION

Figure 1:
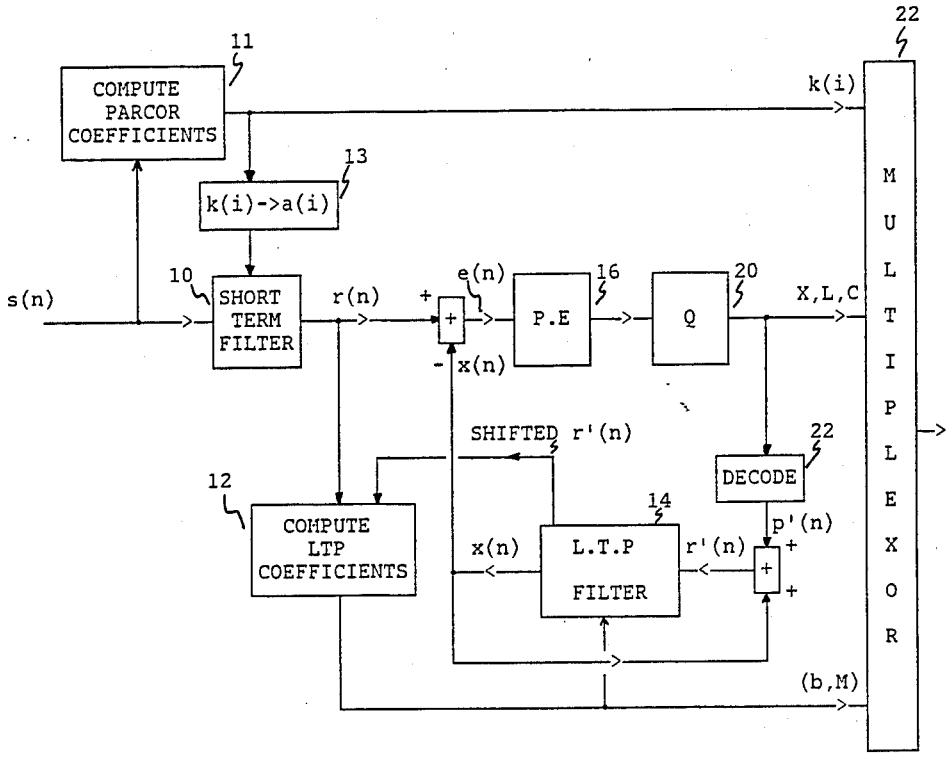
FIG. 1 is a block diagram of a Voice Coder using the invention.

Referring now to the drawings, and more particularly to FIG. 1, there is a block diagram of a coder made to implement the invention. The original speech signal s(n) sampled at Nyquist frequency and PCM encoded with 12 bits per sample is fed into an adaptive short term prediction filter (10) by consecutive blocks 160 samples long.

The filter equation in the z domain is of the form:

$$\Sigma a_i * z^{-i} \quad (1)$$

In other words the short term prediction filter is made of a conventional transversal digital filter the tap coefficients of which are the $a_i$ parameters. The $a_i$ are derived by a step-up procedure in device 13 from so called PARCOR coefficients k(i) in turn derived from the original speech signal using a conventional Leroux-Guegen method and then coded with 28 bits using the Un/Yang algorithm. For reference to these methods and algorithm one may refer to:

J. Leroux and C. Guegen "A fixed point computation of partial correlation coefficients", IEEE Trans on ASSP pp 257–259 June 1977;

C. K. Yun and S. C. Yang "Piecewise linear quantization of LPC reflexion coefficient", Proc. Int. Conf. on ASSP. Hartford, May 1977.

J. D. Markel and A. H. Gray : "Linear Prediction of Speech", Springer Verlag 1976, Step up procedure pp. 94–95.

The short term prediction filter is made to deliver a residual signal r(n) showing a relatively flat frequency spectrum, with some redundancy at a pitch related frequency. A device (12) processes the residual signal to derive therefrom a pitch or harmonic representative data in other words, a pitch related information M and a gain parameter b to be used to adjust a long term prediction filter (14) performing the operations in the z domain as shown by the following equation $$b*z^{-m} \qquad (2)$$

The device for performing the operation of equation (2) should thus essentially include a delay line whose length should be dynamically adjusted to M (pitch or harmonic) and a gain device b. A more specific device will be described further. Efficiently measuring b and M is of prime interest for the coder since a prediction residual signal output x(n) of the long term predictor filter is subtracted from the residual signal to derive a long term decorrelated prediction error signal e(n), which e(n) is then to be coded into sequences of pulses using any Pulse Excitation (PE) method. In other words, a PE device (16) is used to convert for instance each sub-group of 40 consecutive PCM encoded e(n) samples into a smaller number, say less than 15, of most significant pulses. Either one of the MPE or RPE techniques could be used. Lower the dynamic of e(n) is, more efficient its quantizing/coding at a given bit rate is. These considerations help appreciate the importance of a precise adjustment of filter 14 thus of a good evaluation of b and M.

A significant advantage of the coder architecture of FIG. 1 derives from the fact that M may either be representative of the pitch or of a pitch harmonic, i.e. it needs only be a pitch related parameter.

With MPE, say 6 or 8 samples are selected among the e(n) samples for minimizing the mean square error on e(n). These 6 or 8 samples efficiently describe the e(n) signal as long as adequate decorrelation through filter (14) is performed to get a lower signal dynamic.

The new samples provided by device (16) are coded using two set of parameters, one characterizing each pulse position with respect to a significant reference, e.g. the beginning of the sub-block of forty samples being processed, the other one representing each pulse amplitude. Characterizing the pulse position is particularly critical and any error on said position would alter considerably the speech coding quality.

With RPE, the computing workload to be devoted to the pulses is lowered as compared to MPE but this assumes a slightly higher number of pulses (e.g. 13 to 15) is used to describe each sub-group of e(n) samples. Then a higher protection against line errors could be obtained with a lower number of bits.

Briefly stated, when using RPE techniques, each sub-group of 40 samples is split into interleaved sequences. For instance two 13 samples and one 14 samples long interleaved sequences. The RPE device (16), is then made to select the one sequence among the three interleaved sequences again providing the least mean squared error. There is then no need to code each sample position. Identifying the selected sequence with two bits is sufficient. For further information on the RPE coding operation one may refer to the above cited Kroon reference.

The long term prediction associated with regular pulse excitation enables optimizing the overall bit rate versus quality parameter, more particularly when feeding the long term prediction filter (14) with a pulse train r'(n) as close as possible to r(n), i.e. wherein the coding noise and quantizing noise provided by device 16 and quantizer 20 have been compensated for. For that purpose decoding operations are performed in device (22) the output of which p'(n) is added to the predicted residual x(n) to provide a reconstructed residual r'(n). Also, the closed loop structure around the RPE coder is made operable in real time by setting minimal and maximal limits to the pitch detection window as will be explained further.

Figure 2:
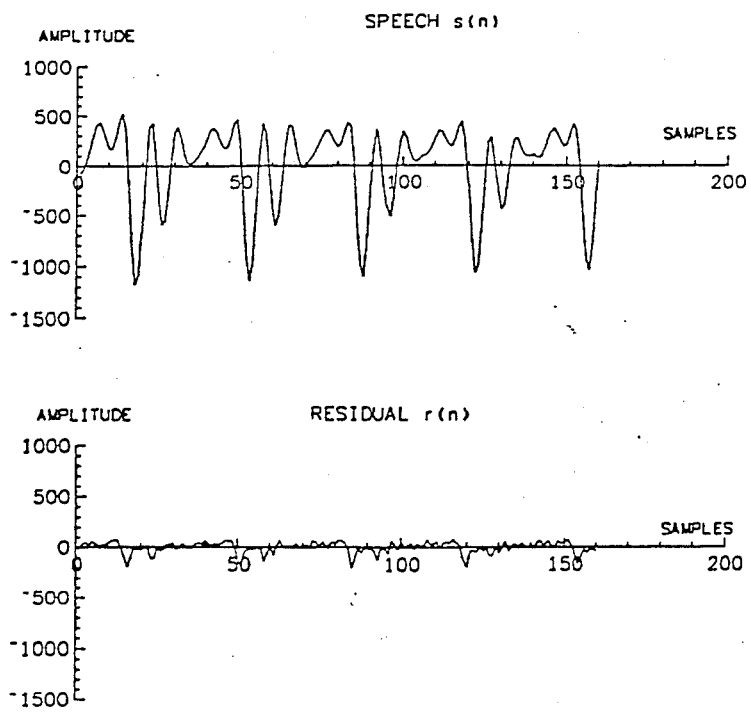
FIG. 2 is an illustration of speech representative waveforms.

The various signals s(n) and r(n) in time domain are represented in FIG. 2, in their analog from. One may notice some sort of redundant pitch related information still remaining in the residual r(n) signal.

The computation of the Long Term Predictor (LTP) (12) parameters may be represented as follows. First each block of 160 r(n) samples is split into four sub-blocks of N=40 samples using a sub-window to lower the computing complexity within the PE coding device (16) while enabling faster refreshing of the information provided by said coding device (16). For each sub-block of samples, the following data are available:

40 r(n) samples;

a set of short term prediction factors are to be assigned to four consecutive sub-blocks including the current one.

b and M are determined four times over each block of 160 samples, using 40 samples (sub-window) and their 120 predecessors.

The device (12) fed with these data computes the long Term Prediction coefficient M as will be described later on and uses it to derive the gain coefficient b according to the following equation:

$$b = \frac{\sum_{N=1}^{N} r(n) * r(n-M)}{\sum_{N=1}^{N} r(n-M)^2}$$

The method for determining M is essential not only to make the whole coder efficient from both quality and complexity standpoints, but also to make the long term prediction arrangement operable in real time. This is achieved by forcing M>N and by splitting the M determination process into two steps. A first step enabling a rough determination of a coarse pitch related M value requiring a fairly low computing power, is then followed by a fine M adjustment using auto-correlation methods over a limited number of values.

1. First step

Rough determination is based on use of non linear techniques involving variable threshold and zero crossings detections more particularly this first step (to be considered with reference to FIG. 3) includes:

Initializing the variable M by forcing it to an empirically determined value, say M=40 sample intervals, or to the previous fine M measured;

Loading a block vector of 160 samples, including the 40 samples of current sub-block of 40 samples, and the 120 previous samples (3 previous sub-blocks);

detecting the positive (Vmax) and negative (Vmin) peaks within said vector;

computing thresholds:

positive threshold $Th^+$=alpha * Vmax negative threshold $Th^-$=alpha * Vmax alpha being an empirically selected number (e.g. alpha=0.5)

setting a new vector X(n) representing the current sub-block according to;

$$X(n)=1 \text{ if } r(n)=>Th^+$$

$$X(n)=-1 \text{ if } r(n)<=Th^+$$

$$X(n)=0 \text{ if } Th^-<r(n)<Th^+$$

This new vector containing only −1, 0 or 1 values will be designated as "cleaned vector";

detecting significant zero crossings (i.e. sign transitions) between two values of the cleaned vector, i.e. zero crossings close to each other;

computing M′ values representing the number of r(n) sample intervals between consecutive detected zero crossings;

comparing M∝0 to the previously rough M by computing ΔM=|M′−M| and dropping any M′ value whose ΔM is larger than a predetermined value K (e.g. K=5);

computing the coarse M value as the mean value of the M′ values not dropped.

Figure 3:
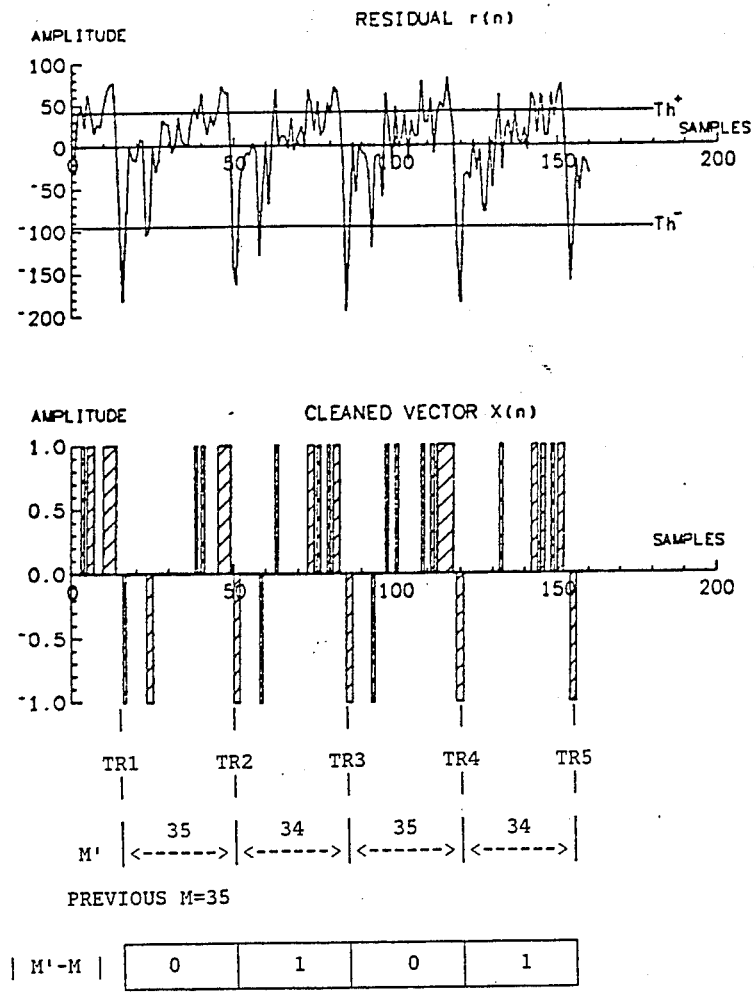
FIGS. 3 and 4 are illustrations of the pitch detection process.

FIG. 3 shows an example of coarse M determination over a residual signal waveform For convenience sake, the residual signal as well as cleaned vector are represented as operating over analog waveforms. In practice, one would consider the pulse code modulation (PCM) sampled representation instead. Dashed zones on the cleaned vector represent one or several consecutive residual samples above $Th^+$ or below $Th^-$, said samples being coded respectively by +1 and −1. The cleaned vector is then scanned to locate zones of transition from +1 to −1 over a limited number of samples. Five transitions zones noted TR1–TR5 have been located on the considered example. The number of samples between consecutive TR locations are computed and noted as M′ value with M′=35; 34; 35 and 34 for a whole block of 160 samples.

Assuming the previously measured M value be equal to 35, 66 M=0; 1; 0 and 1 respectively, then none of the M′ values would be far enough from 35 to be dropped. The final (coarse) rough value of M would then be:

$$M = \frac{35 + 34 + 35 + 34}{4}$$

M is then considered equal to 35.

It should be noted that the experimentally selected value of alpha is equal to 0.5, which guarantees in practice that at least 1 value of M′ would be selected. Also, once a significant transition zone is detected, a few samples are ignored before starting to locate next significant transitions. This enables minimizing the effect of noisy peaks about the pitch as may be seen on the samples located close to n=60 and n=90. The number of ignored samples corresponds to the minimal detectable pitch. And finally, the maximum acceptable ΔM value should be high enough to ascertain computing the mean M value over a significant number of M′.

2. Second step: fine M determination is based on the use of autocorrelation methods but is operated over a low number of samples taken around the samples located in the neighborhood of the pitched pulses.

In other words, a set of R(k′) values is derived from $$R(k') = \sum_{n=1}^{40} r(n) * r(n - k') \tag{4}$$

for $k'=K*M+/-Delta$, locating the sample within the block, with:

n=1 referring to r(1) of sub-block "k" (see FIG. 4) and K=1,2,3.

K being the sample rank index locating the peaks at multiples of rough M rate, and Delta=5 for instance defining a number of sample locations about said pitched peaks.

In other words, the autocorrelation operation of equation (4) is operated between the 40 samples of sub-block (k) and 40 samples, the first of which is one of the autocorrelation zones samples, then jumping to the next autocorrelation zone. This enables thus saving on computing load. The second step illustrated in FIG. 4, includes:

Initializing the M value either as being equal to the rough (coarse) M value just measured assuming it is different from zero otherwise as being equal to the last measured fine M;

locating the autocorrelation zones based on the roughly located pitch and Delta;

eliminating from these zones the non significant index values k′ i e , keeping only the values such that:

$$40<=k'<=120$$

Figure 4:
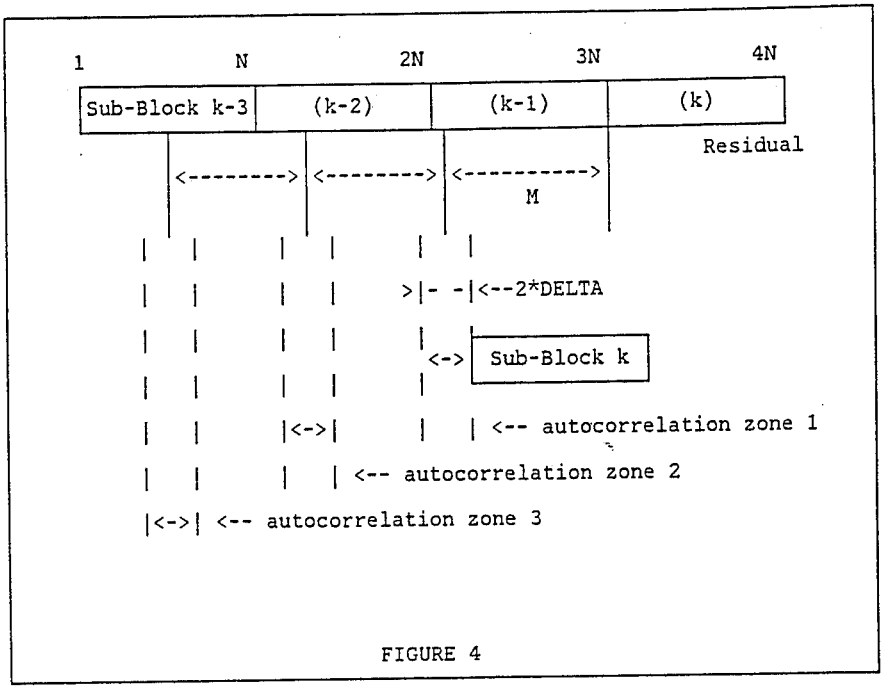

For instance, the example shown on FIG. 4 would result in a partial elimination of zone 1.

computing the autocorrelation coefficients R(k′) using equation 4;

locating the maximum R(k′)=autocorrelation peak, to detect the fine M value; and, computing the gain factor b according to equation (3).

The value of Delta has been set to 5 and the autocorrelation zones limited to the three first coarse M spaced peaks.

Figure 5:
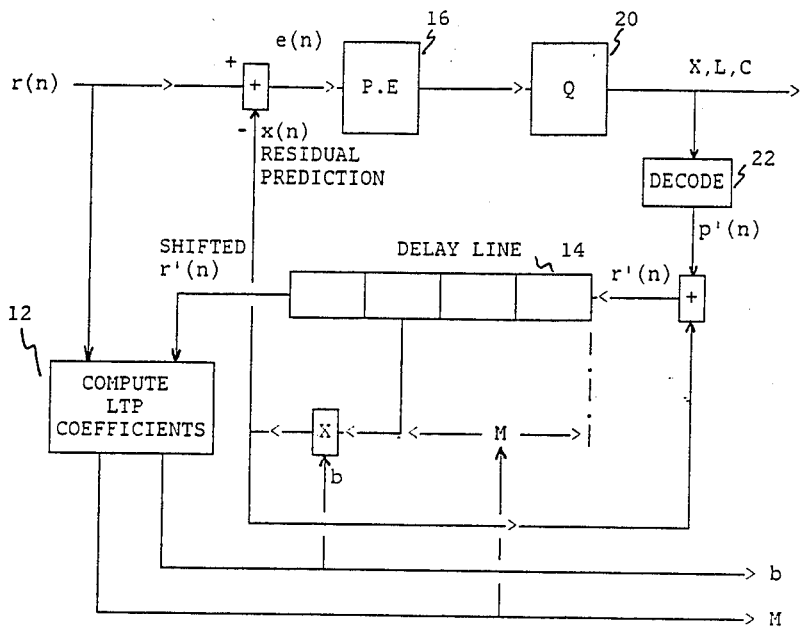
FIGS. 5 and 6 are block diagrams of the coder.

A saving on data storage is achieved by using reconstructed shifted samples r′(n-k′) instead of samples r(n-k′) in relation (4) and by using samples r′(n) instead of samples r(n) in relation (3), as shown in FIG. 5.

In FIGS. 8, 9, 10 and 11 are flow charts representing the algorithms used to implement the above described M pitch determination.

Figure 8:
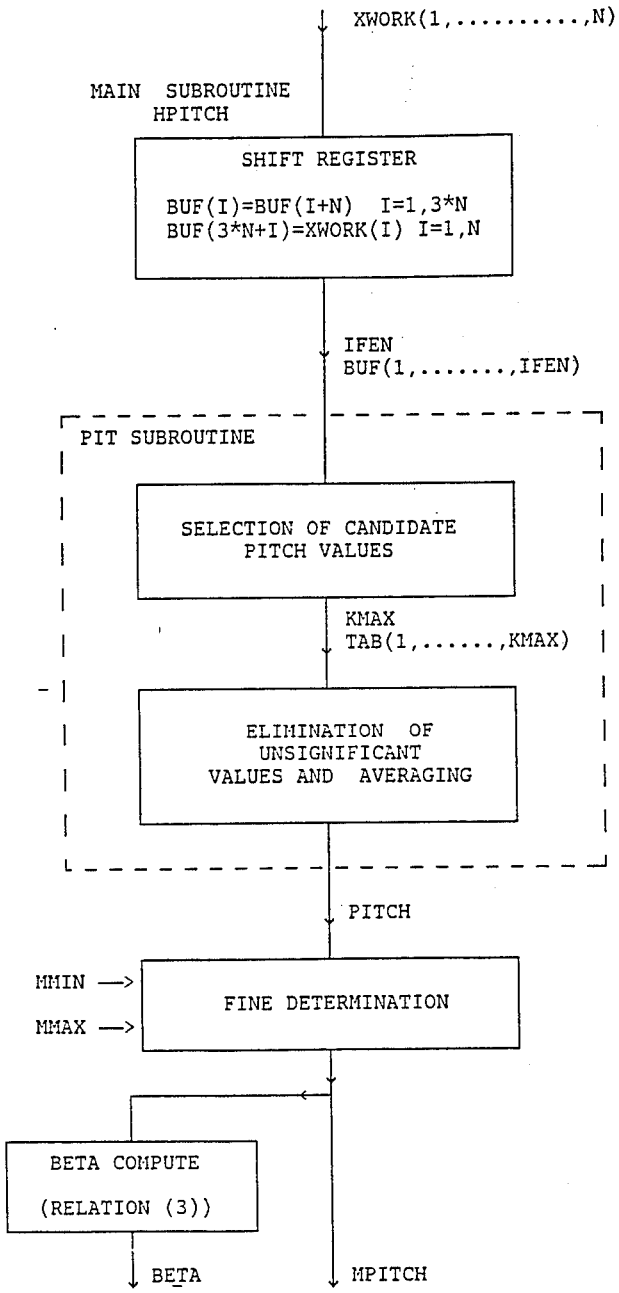
FIG. 8 is a block diagram for the general architecture of the system which implements the pitch determination.
Figure 9:
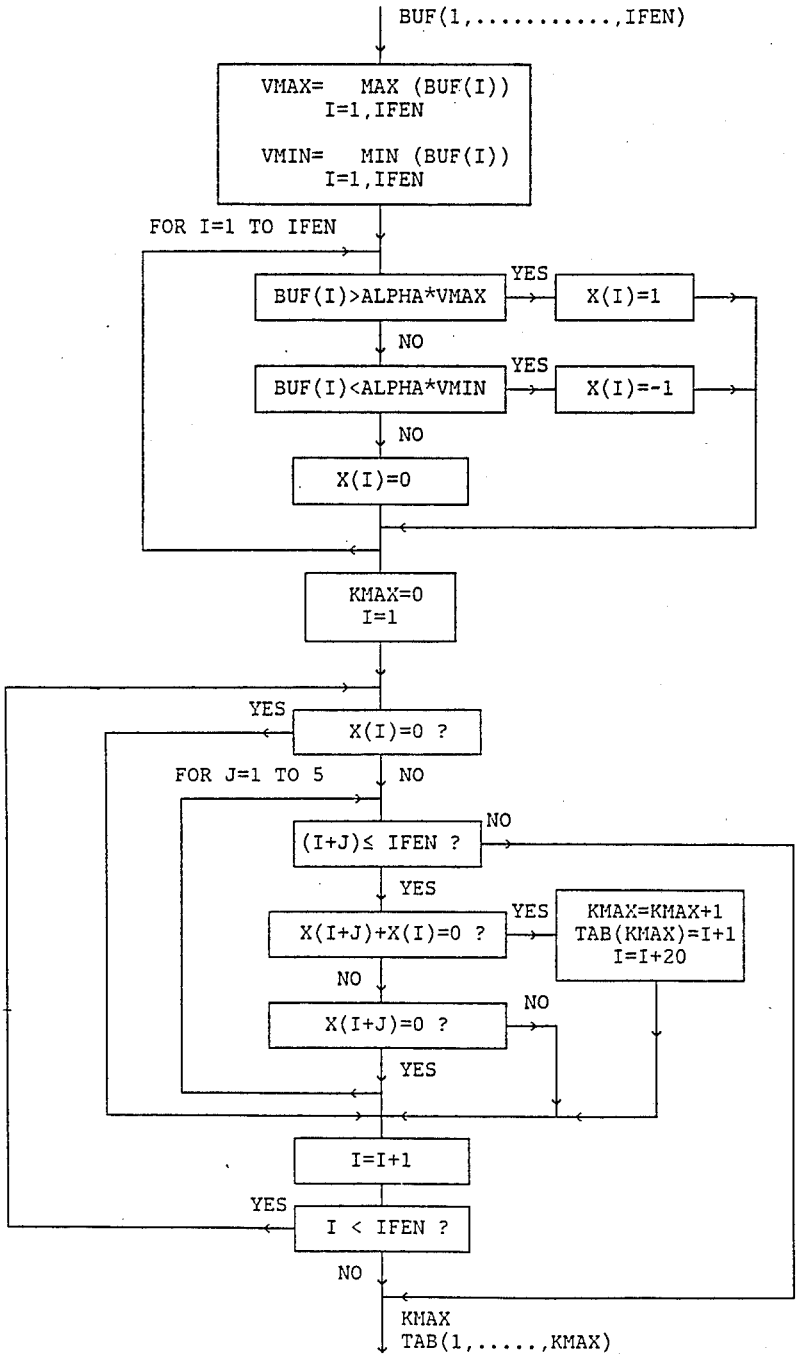
FIG. 9 is a block diagram of the algorithm for the selection of candidate values for pitch.
Figure 10:
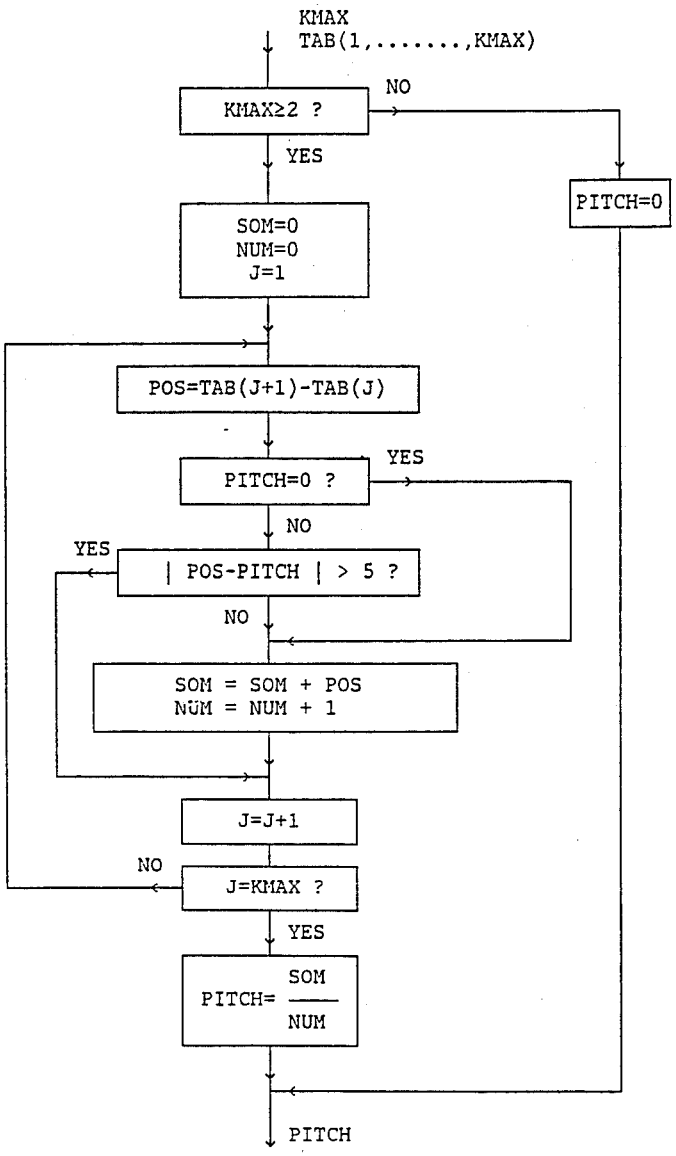
FIG. 10 is a block diagram of the algorithm for the elimination of insignificant values and averaging for the determination of the rough pitch value.

The flowcharts are self explanatory with the following definitions:

Main Subroutine=HPITCH deals with fine pitch and gain b determination through autocorrelation operations for fine pitch (FIG. 8).

| Input parameters | |
|---|---|
| XWORK | Table of N samples r(n), n = 1, 40 |
| MMIN | Minimum assigned to M |

-continued

| Input parameters | |
|---|---|
| MMAX | Maximum assigned to M |
| Out parameters | |
| MPITCH | Fine pitch M value |
| Beta | Gain coefficient b. |

Other sub-routines (1) Sub-routine PIT: Determination of coarse M value using center clipping, zero crossing operations, and averaging

| Input parameters | |
|---|---|
| BUF | Table of r(n) signal samples (n = 1, 160) |
| IFEN | Buffer length |

Output parameters:

PITCH coarse pitch M value

This subroutine includes two steps:

1st step: Selection of candidate pitch values which are stored in a table TAB (1, . . . , KMAX). (see flowgraph in FIG. 9), 2nd step: Elimination of insignificant values and averaging (see flow graph in FIG. 10), to count a coarse estimate PITCH.

Figure 11:
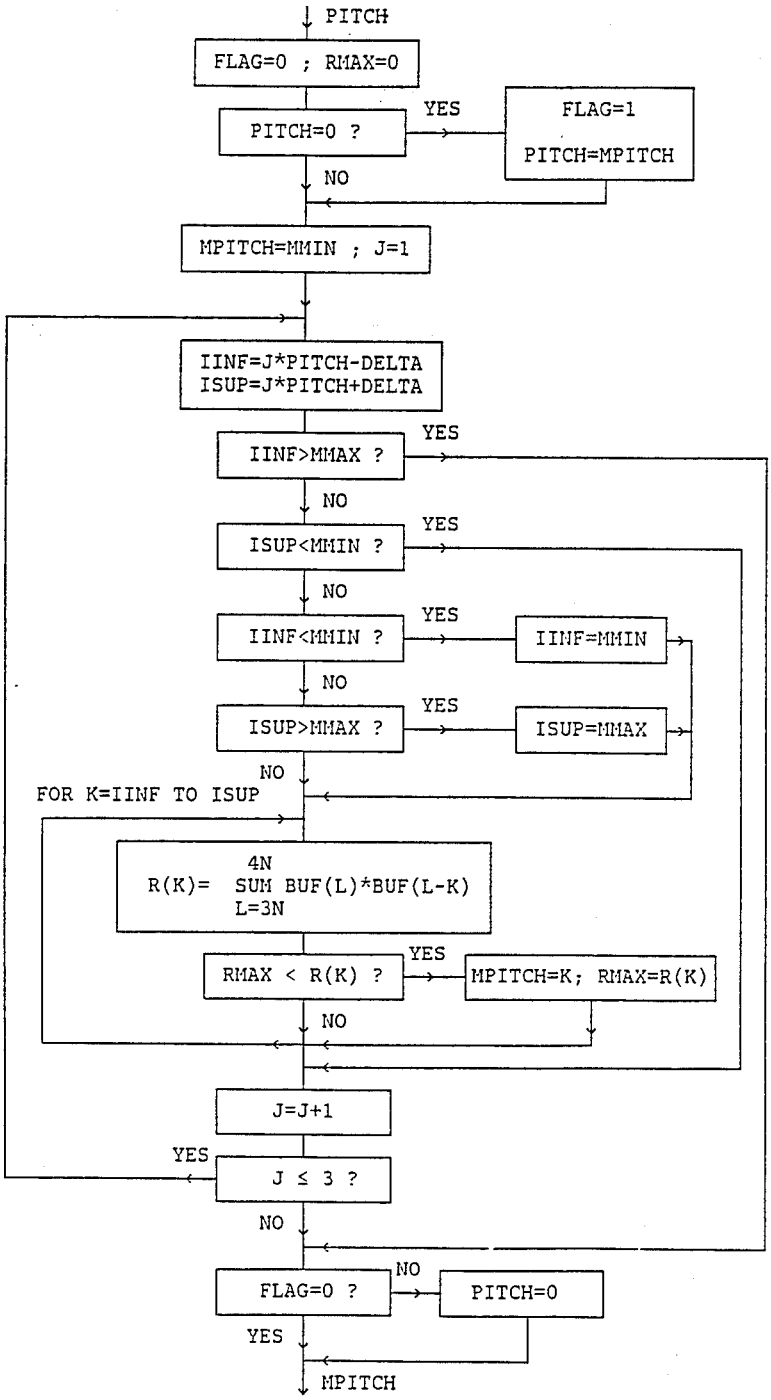
FIG. 11 is a block diagram of the algorithm for the fine determination of the pitch value.

(2) Subroutine HPITCH: Fine determination of pitch. input parameter: PITCH: coarse pitch M value output parameter: MPITCH: fine pitch M value FIG. 11 represents the detailed flowgraph of this subroutine.

An implementation of Long Term Prediction filter (14) is represented in FIG. 5 (see FIG. 1 for similar references). The reconstructed residual signal is fed into a 160 samples long delay line (or shift register) D L the output of which is fed into the LTP coefficients computing means (12) for further processing through cross-correlations with r(n). A tap on the delay line DL is adjusted to the previously computed fine M value. A gain factor b is applied to the data available on said tap, before being subtracted from r(n) as a residual prediction x(n) to generate e(n).

The long term predicted residual signal is thus subtracted from the residual signal to derive the error signal e(n) to be coded through Pulse Excitation device (16) before being quantized in quantizer (20).

An optimal approach to e(n) coding has been implemented using a Regular Pulse Excited (RPE) Coder the principle of which has been described in the above cited Kroon et al reference.

Figure 6:
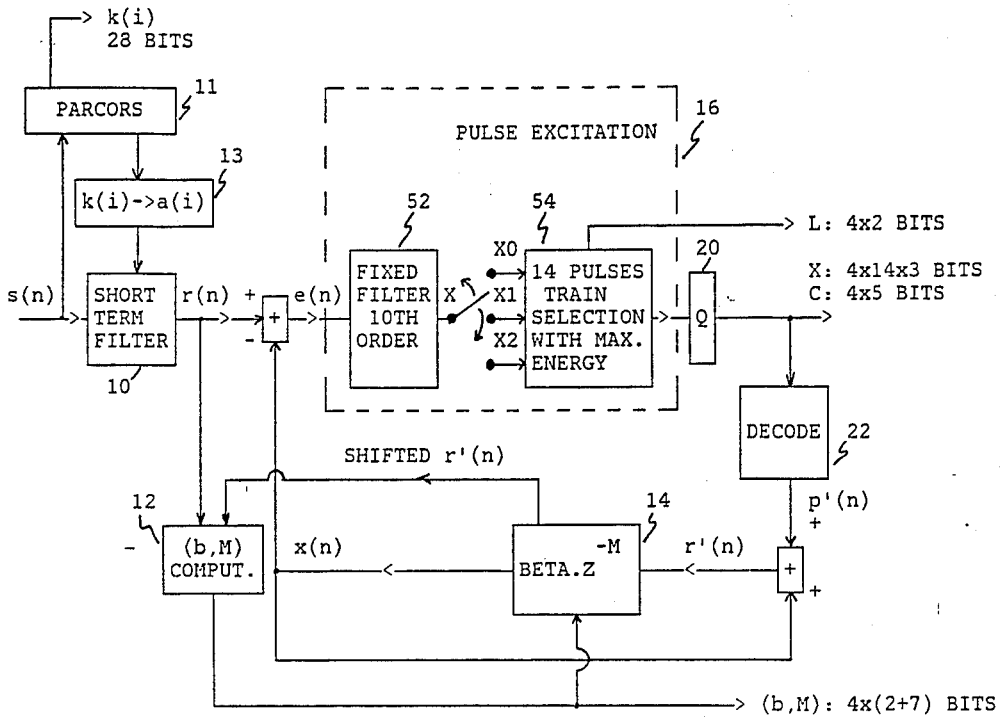

Represented in FIG. 6 is a device implementing the RPE function as considered with the coder of FIG. 1. The residual is low-pass filtered in (52) to a low bandwidth limited at 1,66 Khz. Then each sub block of 40, x(n) samples is split in device (54) into three interleaved sequences $X_0$, $X_1$, and $X_2$ as represented hereunder:

$X_0$ X00X00X00X00X00X00X00X00X00X00X00X00X00X
1 40

$X_1$ 0X00X00X00X00X00X00X00X00X00X00X00X00X00
1 40

-continued $X_2$ 00X00X00X00X00X00X00X00X00X00X00X00X00X0
1 40

Where "X" represents a non zero pulse taken among the x(n) samples.

The three pulse trains X0, X1 and X2 energies are computed, and the pulse train showing the highest energy is selected to represent the residual signal e(n) for the considered 40 samples long operating time window. A two bits long parameter L is used to define the selected sequence $X_0$, $X_1$ or $X_2$. This parameter is thus provided by the coder output four times every block of 160 samples. The pulses selected are quantized into a sequence "X". Therefore both L and "X" parameters define the e(n) coded signal. In practice, block companded PCM techniques are used to encode the X sample sequence. These technique have been presented by A. Croisier et al in a presentation at the International Seminar on Digital Communications, Zurich 1974.

Each 40 samples long e(n) sequence is finally encoded into a characteristic term encoded with five bits and 13 or 14 samples each encoded with three bits.

Figure 7:
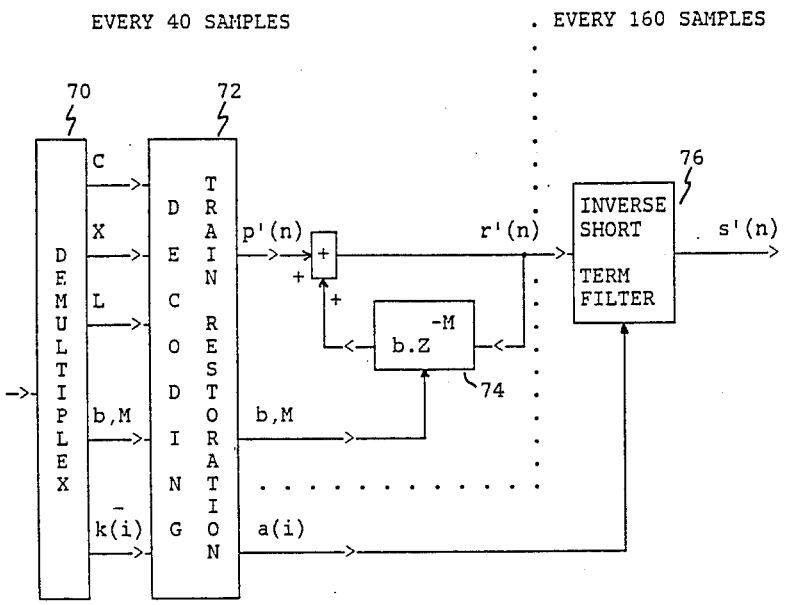
FIG. 7 is a block diagram of the decoder.

Represented in FIG. 7 is the decoder or synthesizer to be used with this invention. The received data train is first demultiplexed in 70 to separate the various components (C, X, L, b, M and k(i) from each other. C and X are used in a conventional BCPCM decoder to regenerate in (72) the e(n) pulse train the time position of which is adjusted with reference to the block time origin using the parameter L. In other words, L enables setting an additional time delay to either zero, one or two sampling periods depending whether L indicates that the selected pulse train was X0, X1 or X2. The decoded pulses p'(n) are then fed into an inverse long term prediction filter (74) the parameters of which are adjusted by b and M. These operations are performed every 40 samples, i.e. one sub-block window duration. The inverse filter provides a decoded residual signal r'(n) fed into an inverse short term prediction filter (76) the coefficients of which are adjusted each 160 samples long period of time using the PARCOR coefficients k(i) (or the corresponding coefficients a(i)). The decoded speech signal s'(n) is provided at the output of inverse short term filter (76).

Thanks to the very efficient method for detecting the long term predictor parameters, and more particularly the pitch related M parameter, a very efficient 16 Kbps voice coding is achieved. More particularly, the bits assignment have been made as follows: For each block of 20 ms long speech signal section:

| For each block of 20 ms long speech signal section: | | |
|---|---|---|
| Parcors (Ki) | | 28 bits |
| Characteristics (C) | 4 × 5 = | 20 bits |
| Amplitudes (X) | 4 × 14 × 3 = | 168 bits |
| Positions (L) | 4 × 2 = | 8 bits |
| Gain (b) | 4 × 2 = | 8 bits |
| pitch (M) | 4 × 7 = | 28 bits |
| Total | | 260 bits |

which corresponds to a rate of 13 Kbps leaving 3 Kbps for error protection for a 16 Kbps coder.

While the invention has been described in terms of a preferred embodiment in a specific environment, those skilled in the art will recognize that the invention can be practiced, with modification, in other and different environments within the spirit and scope of the appended claims.

We claim:

1. Method for detecting related data (M) in a representative signal split into blocks of samples including a rough M determination followed by a fine M determination, said method comprising the steps of:

a. for said rough M determination:
   1. setting a positive threshold (Th+) and a negative threshold (Th−) based on characteristics of the representative signal;
   2. locating and storing a plurality of samples representative of said blocks of samples, having magnitudes above and below said Th+ and Th−;
   3. Identifying significant signal magnitude transitions within said blocks of samples;
   4. storing a set of values M′ indicative of said samples between each of said significant signal magnitude transitions; and
   5. averaging said set of values M′ to calculate said rough M determination; and b. for said fine M determination:
   1. setting a plurality of autocorrelation zones about said plurality of samples;
   2. splitting said blocks of samples into consecutive sub-blocks of samples;
   3. autocorrelating, using the autocorrelation zones of a current sub-block of samples; and
   4. setting the fine M value equal to a maximum value for said current sub-block of samples in accordance with step 3 of said fine M determination.

2. Method for detecting pitch related data (M) in a representative signal, as recited in claim 1, wherein said step of setting a plurality of autocorrelation zones about said plurality of samples includes the steps of:

a. locating a maximum value and a predetermined delta variation in each of said plurality of samples to define said autocorrelation zones; and
b. filtering said autocorrelation zones to remove any non significant values.

3. Method for detecting pitch related data (M) in a representative signal, as recited in claim 1, further comprising the step of calculating a residual signal r(n) from said representative signal by a short-term filtering operation using a digital filter to be processed and subsequently quantized into an output signal.

4. Method for detecting pitch related data (M) in a representative signal, as recited in claim 3, including the steps of:

a. tuning a long term prediction filter;
b. generating a predicted residual signal;
c. subtracting said predicted residual signal from a residual signal r(n); and
d. deriving therefrom a prediction error signal e(n) to be coded and subsequently quantized into an output signal.

5. Method for detecting pitch related data (M) in a representative signal, as recited in claim 4, including the step of encoding a prediction error signal e(n) using regular pulse excitation techniques to convert each sub-block of said predictive error signal e(n) samples into a shorter sequence selected from a set of sequences of samples.

6. Method for detecting pitch related data (M) in a representative signal, as recited in claim 5, including the step of adjusting said long term prediction filter with a gain factor b based on said fine M value.

7. Apparatus for detecting pitch related data (M) in a representative signal split into blocks of samples including a rough M determination followed by a fine M determination; comprising:

a. for said rough M determination:
   1. means for setting a positive threshold (Th+) and a negative threshold (Th−) based on characteristics of the representative signal;
   2. means for locating and storing a plurality of samples representative of said blocks of samples, having magnitudes above and below said Th+ and Th−;
   3. means for identifying significant signal magnitude transitions within said blocks of samples;
   4. means for storing a set of values M′ indicative of said samples between each of said significant signal magnitude transitions; and
   5. means for averaging said set of values M′ to calculate said rough M determination; and b. for said fine M determination:
   1. means for setting a plurality of autocorrelation zones about said plurality of samples;
   2. means for splitting said blocks of samples into consecutive sub-blocks of samples;
   3. means for autocorrelating using the autocorrelation zones of a current sub-block of samples; and
   4. means for setting the fine M value equal to a maximum value for the current sub-block of samples utilizing the output of the means for autocorrelating a current sub-block of samples.

8. Apparatus for detecting pitch related data (M) in a representative signal, as recited in claim 7, wherein said means for setting a plurality of autocorrelation zones about said plurality of samples includes;

a. means for locating a maximum value and a predetermined delta variation in each of said plurality of samples to define said autocorrelation zones; and
b. means for filtering said autocorrelation zones to remove any non significant values.

9. Apparatus for detecting pitch related data (M) in a representative signal, as recited in claim 7, further comprising means for calculating a residual signal r(n) from said representative signal by a short-term filtering operation using a digital filter to be processed and subsequently quantized into an output signal.

10. Apparatus for detecting pitch related data (M) in a representative signal, as recited in claim 7, including:

a. means for tuning a long term prediction filter;
b. means for generating a predicted residual signal;
c. means for subtracting said predicted residual signal from a residual signal r(n); and
d. means for deriving therefrom a prediction error signal e(n).

11. Apparatus for detecting pitch related data (M) in a representative signal, as recited in claim 7, including means for encoding a prediction error signal e(n) using regular pulse excitation techniques to convert each sub-block of said predictive error signal e(n) samples into a shorter sequence selected from a set of sequences of samples to be processed and subsequently quantized into an output signal.

12. Apparatus for detecting pitch related data (M) in a representative signal, as recited in claim 7, including means for adjusting said long term prediction filter with a gain factor b based on said fine M value.

* * * * *